United States Patent [19]

Edwards et al.

[11] Patent Number: 4,678,443

[45] Date of Patent: Jul. 7, 1987

[54] INFLATABLE LIFERAFT

[75] Inventors: David V. Edwards, Billingshurst; Michael A. Newman, Haslemere, both of England

[73] Assignee: RFD Limited, Surrey, England

[21] Appl. No.: 831,330

[22] Filed: Feb. 20, 1986

[30] Foreign Application Priority Data

Feb. 22, 1985 [GB] United Kingdom ..... 8504628

[51] Int. Cl.[4] ..... B63B 35/58

[52] U.S. Cl. ..... 441/38; 441/40

[58] Field of Search ..... 441/35, 37, 38, 39, 441/40–41, 42; 114/345

[56] References Cited

U.S. PATENT DOCUMENTS

| | | | |
|---|---|---|---|
| 2,914,779 | 12/1959 | Walker | 441/39 |
| 2,972,758 | 2/1961 | Belin | 441/38 |
| 3,034,154 | 5/1962 | Silverstone | 441/40 X |
| 3,123,843 | 3/1964 | Tanger | 441/38 |

FOREIGN PATENT DOCUMENTS

| | | | |
|---|---|---|---|
| 1127922 | 12/1956 | France | 441/40 |

*Primary Examiner*—Sherman D. Basinger

*Attorney, Agent, or Firm*—Birch, Stewart, Kolasch & Birch

[57] ABSTRACT

An inflatable liferaft comprises an inflatable buoyancy tube side wall structure and a floor so secured at its periphery to the side wall structure that the inflated liferaft can be used when deployed on water either way up. An inflatable protective tube structure inflates with the side wall structure and takes up a protective location in which it extends round the outside of the side wall structure. The protective tube structure is, however, displaceable either way from its protective location to a canopy support location above the floor of the liferaft and a canopy assembly is so secured to the protective tube structure and to the side wall structure that when the protective tube structure moves to its canopy support location the canopy assembly deploys with the protective tube structure and is supported thereby.

11 Claims, 11 Drawing Figures

INFLATABLE LIFERAFT

Figure 1:
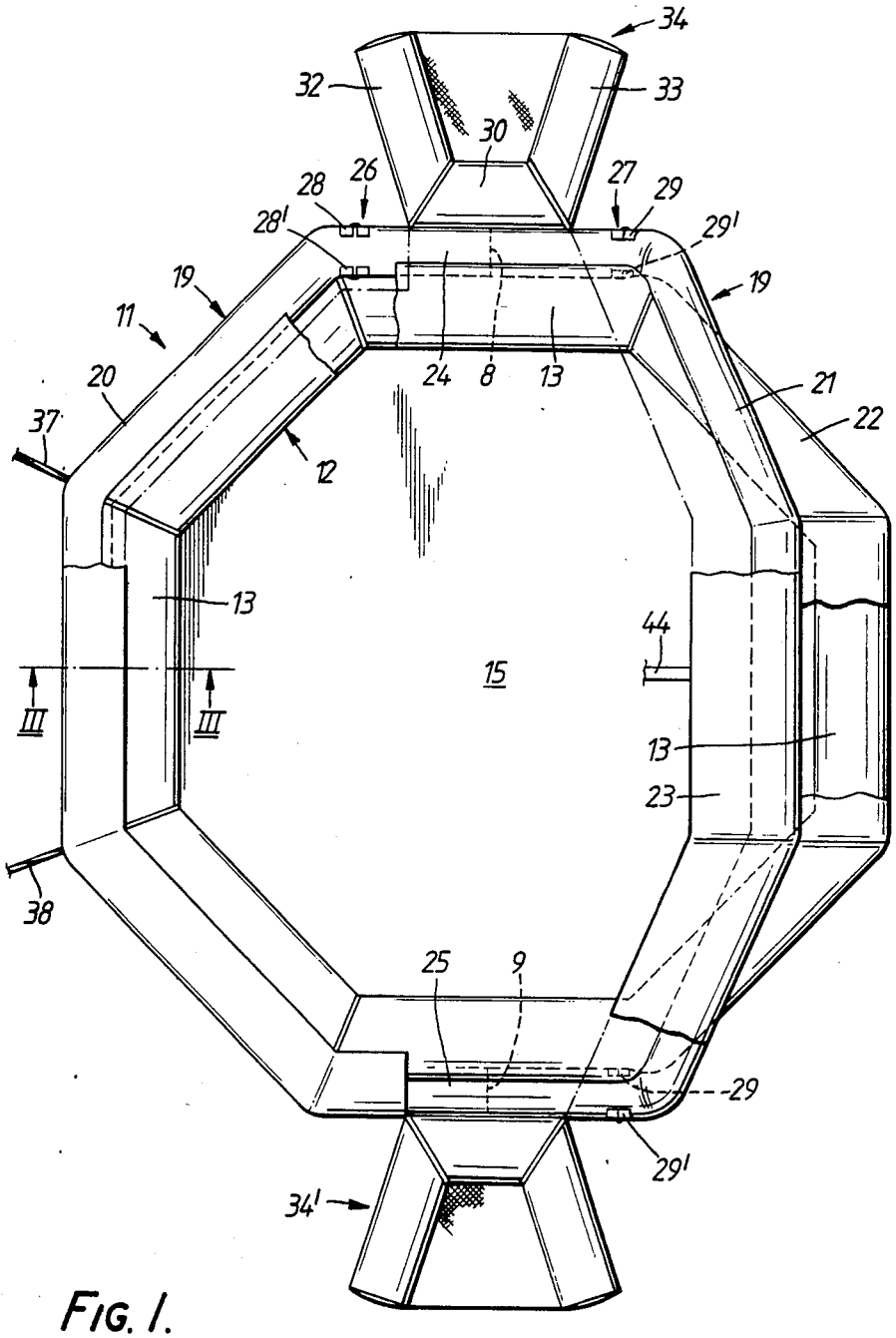

The present invention relates to inflatable liferafts and is particularly concerned with a reversible inflatable liferaft, that is to say, an inflatable liferaft which can be boarded and used when inflated and deployed on water either way up.

It is a requirement to equip aircraft with inflatable liferafts which have inflatable canopy support structures which automatically inflate at the same time or immediately following inflation of the main buoyancy chambers of the liferaft. As a consequence of this, non-reversible inflatable liferafts have hitherto been proposed and although they are designed to ensure a high probability of inflation in an upright condition on water there remains nevertheless the prospect of having to right the liferaft on those occasions where it fails to deploy and inflate the right way up. There is, nevertheless, a growing recognition that for aviation purposes a high probability of upright inflation is no longer acceptable and that the liferafts to be used for aircraft emergencies must be immediately available for boarding either way up. Furthermore, where the liferafts are to be used in circumstances where deployment of them is itself hazardous, as for example when used by evacuees from a helicopter forced to land on water, there is now a further requirement that the liferafts used should be highly resistant to damage or at least damage tolerant during deployment and boarding by evacuees from the helicopter.

It is an object of the present invention to provide an inflatable liferaft which can, when deployed and inflated, be boarded and used either way up, which has an inflatable canopy support structure which inflates when the liferaft is inflated and which offers an additional measure of protection against damage during deployment and boarding.

According to the present invention, there is provided an inflatable liferaft comprising an inflatable buoyancy tube side wall structure and a floor so secured at its periphery to the side wall structure that the inflated liferaft can be used when deployed on water either way up, an inflatable protective tube structure which upon deployment of the liferaft inflates with the side wall structure to take up a protective location in which it extends round the outside of the side wall structure and which is displaceable from its protective location either way to a canopy support location above the floor of the liferaft, and a canopy assembly so secured to the protective tube structure and to the side wall structure that when the protective tube structure moves to its canopy support location the canopy assembly deploys with the protective tube structure and is supported thereby.

In a preferred embodiment of the invention the canopy assembly comprises a canopy side sheet connected to and extending between the side wall structure and the protective tube structure and a canopy top sheet connected to the protective tube structure and arranged in the canopy support location of the protective tube structure to extend across the top of the liferaft. Preferably, when the protective tube structure is in the protective location the canopy side sheet is held in a collapsed and folded condition between the protective tube structure and the side wall structure and the canopy top sheet is held in a collapsed and folded condition against the outside of the protective tube structure.

In the embodiments of the invention hereinafter to be described, the protective tube structure comprises an inflatable protective tube extending round the sidewall structure in the protective location. The protective tube comprises one or more displaceable arched tube sections, the or each of which extends round the sidewall structure between constraint locations thereon and is displaceable into a canopy support location to provide an arched tube support for the canopy assembly.

In the preferred embodiments of the invention hereinafter to be described, the protective tube comprises two displaceable arched tube sections, one of which extends round one half of the side wall structure of the liferaft and is displaceable to a first canopy support location and the other of which extends round the other half of the side wall structure and is displaceable to a second canopy support location spaced from the first support location. Where the side wall structure comprises two superposed inflatable buoyancy tubes, the arched tube sections may conveniently be arranged in their protective locations to seat between and against the outer walls of the two buoyancy tubes. Preferably, one of the arched tube sections is inflated by the inflation medium supplied to inflate one of the buoyancy tubes of the side wall structure and the other arched tube section is inflated by the inflation medium supplied to inflate the other buoyancy tube of the side wall structure.

In the preferred embodiments of the invention hereinafter to be described, the canopy top sheet comprises two top sheet portions, one of which is secured to one of the arched tube sections and the other of which is secured to the other arched tube section and the arrangement is such that when the two arched tube sections take up their canopy support locations the extended two top sheet portions abut or overlap and can be secured together to form a continuous canopy roof.

The protective tube may be held axially compressed at constraint locations by constraint elements, whereby when the or each arched tube section is displaced in the direction of its canopy support location it bends locally at the constraint locations. The protective tube may alternatively be held axially compressed at the constraint locations by constraint elements which bias the or each arched tube section to cause it to move automatically to its canopy support location upon selective removal or overriding of one or more of the constraint elements. Where the arched tube sections of the protective tube are arranged in their protective location to seat against and between the two buoyancy tubes forming the sidewall structure, compression of the inflatable protective tube at the constraint locations is arranged to be such as upon selective removal of the constraint elements the or each arched tube section is displaced out of its seat between the buoyancy tubes and moves to its support location.

Figure 2:
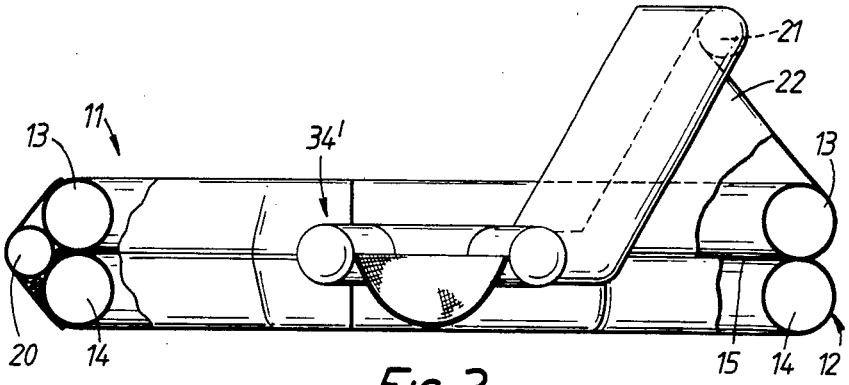
Figure 3:
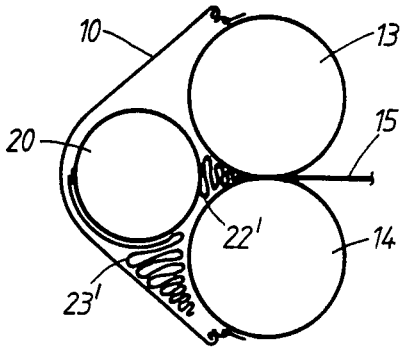
Figure 4:
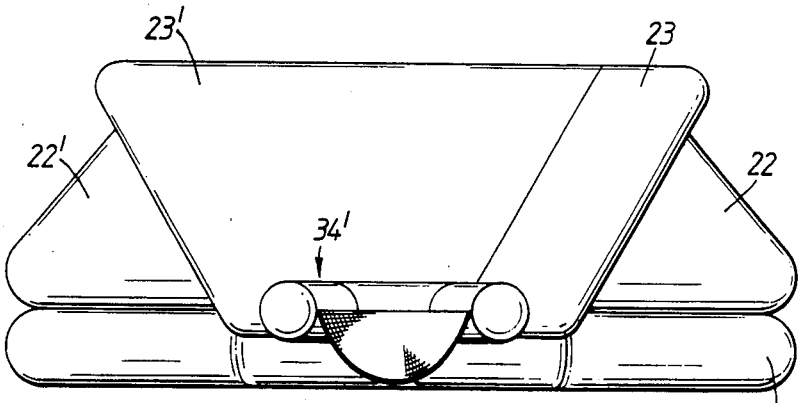
Figure 5:
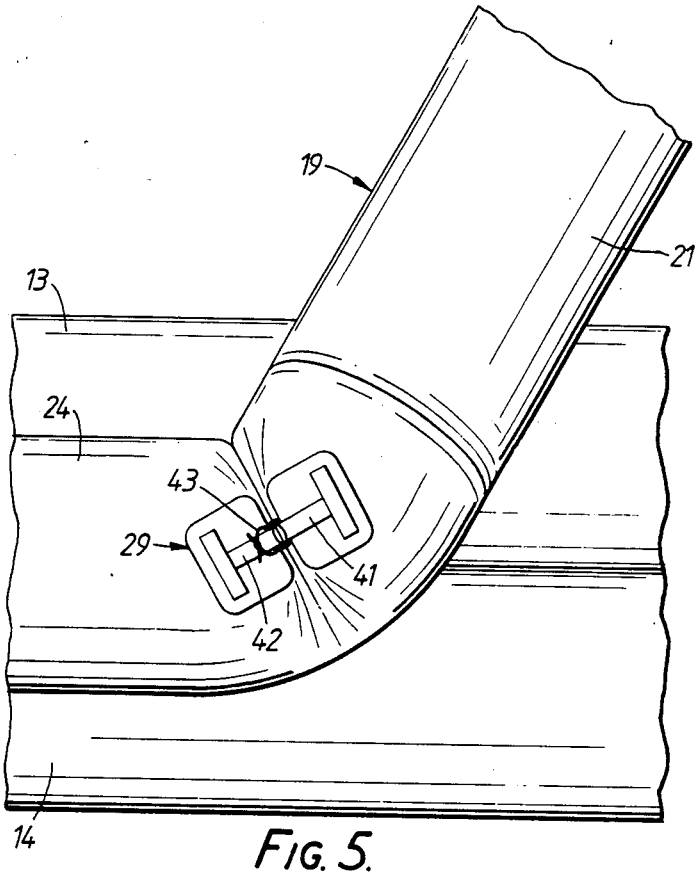
Figure 6:
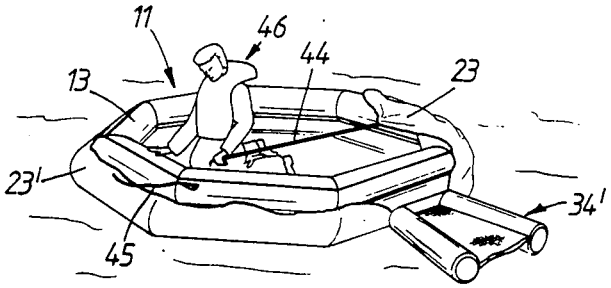
Figure 7:
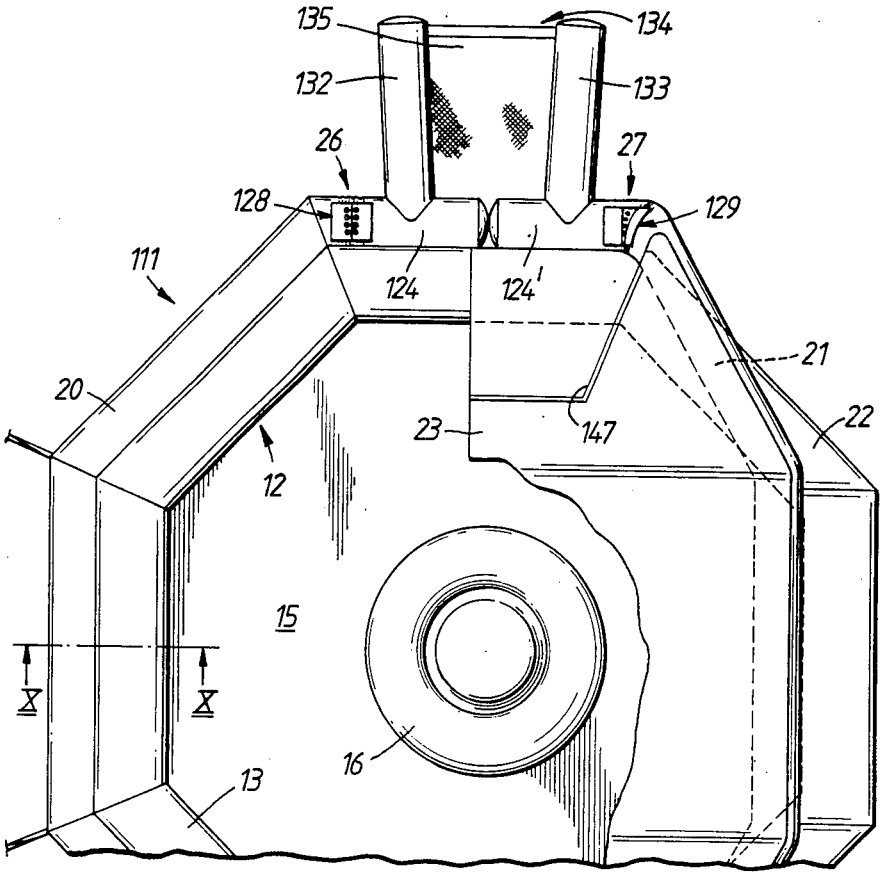
Figure 8:
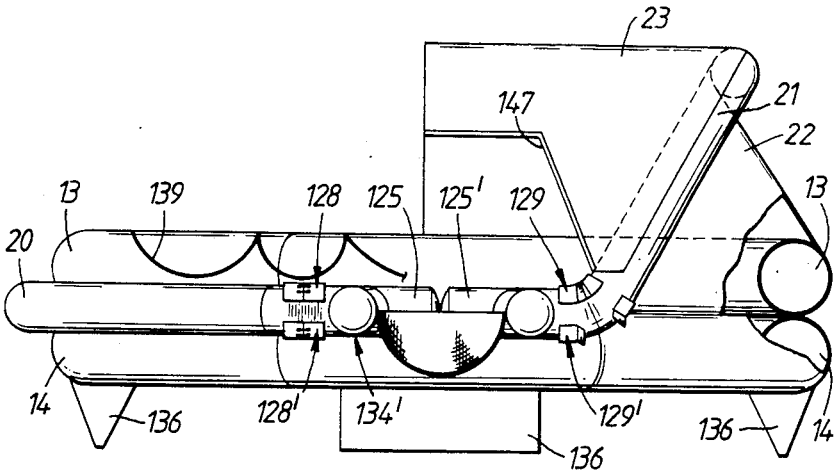
Figure 9:
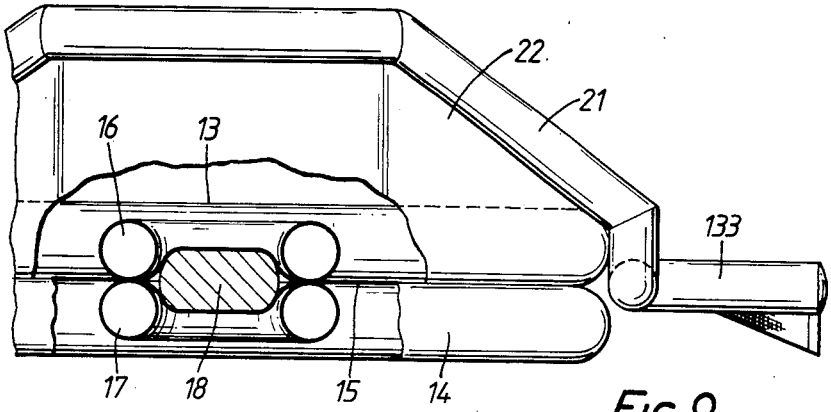
Figure 10:
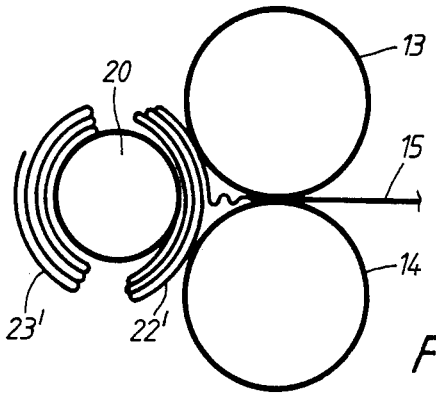
Figure 11:
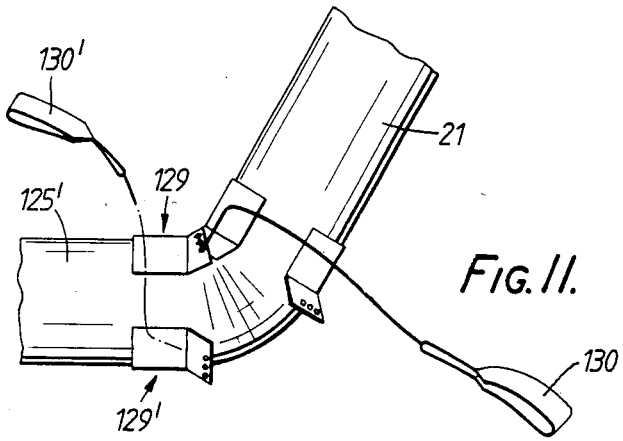

Two embodiments of the invention will now be described by way of example with reference to the accompanying drawings in which:

FIG. 1 a schematic plan view of part of a reversible inflatable liferaft according to a first embodiment of the invention, showing some parts cut away and some parts positioned before canopy deployment and other parts after canopy deployment, FIG. 2. is a schematic side elevation of the liferaft shown in FIG. 1, with some parts cut away, FIG. 3 is a schematic section of a part of the liferaft shown in FIG. 1, taken on the line III—III in FIG. 1, FIG. 4 is a schematic side elevation corresponding to that shown in FIG. 2, showing the canopy of the liferaft fully deployed, FIG. 5 is a schematic scrap view of part of the liferaft shown in FIG. 2, drawn to an enlarged scale, FIG. 6 is a schematic perspective view of the deployed liferaft FIG. 1, ready for canopy deployment, FIG. 7 is a schematic plan view of a reversible inflatable liferaft according to a second embodiment of the invention, showing some parts cut away and some parts positioned before canopy deployment and other parts positioned after canopy deployment, FIG. 8 is a schematic side elevation of the liferaft shown in FIG. 7, with some parts cut away, FIG. 9 is a schematic side elevation corresponding to that shown in FIG. 8, showing other parts of the liferaft in detail;

FIG. 10 is a schematic section of a part of the liferaft shown in FIG. 7, taken on the line X—X in FIG. 7, and FIG. 11 is a schematic scrap view of part of the liferaft shown in FIG. 8, drawn to an enlarged scale.

Referring first to FIGS. 1 to 3 of the drawings, an inflatable liferaft 11 is shown which comprises a peripheral buoyancy tube sidewall structure 12 formed by upper and lower superposed inflatable buoyancy tubes 13 and 14, a floor 15, the periphery of which is secured to the two buoyancy tubes 13,14 in the region where they are joined together in superposed relation, and a protective tube structure formed by a continuous inflatable tube 19 having the same configuration in plan view as the buoyancy tubes 13 and 14 and adapted to extend round the outside of the two tubes 13,14.

The protective tube 19 comprises two displaceable arched tube sections 20 and 21 and two end tube sections 24 and 25. Each of the arched tube sections 20,21 is displaceable from its location around the outside of the buoyancy tubes 13,14 either way, in dependence upon the disposition of the liferaft on the water, to a canopy support location in which it provides support for a canopy assembly. In FIG. 1, the tube section 20 is shown in its protective location round the outside of the buoyancy tubes 13 and 14 while the tube section 21 is shown in its canopy support location in which it provides an arched tube support for a canopy side sheet 22 connected to and extending from the junction of the buoyancy tubes 13,14 to the arched tube section 21 and a canopy top sheet 23 connected to the tube section 21. In the protective location, as illustrated by the tube section 20 in FIG. 3, a canopy side sheet 22', corresponding to the side sheet 22, is held in a collapsed and folded condition between the tube section 20 and the two buoyancy tubes 13,14 and a canopy top sheet 23', corresponding to the top sheet 23, is held in a collapsed and folded condition between the tube section 20 and the buoyancy tube 14. The side sheet 22 and the top sheet 23 are likewise arranged in collapsed and folded condition when the arched tube section 21 extends round the outside of the buoyancy tubes 13 and 14 in its protective location thereon. As will be seen, the tube section 20 and the two buoyancy tubes 13,14, together with the canopy side and top sheets 22',23' are enclosed by a cover sheet 10 which extends as shown from one end of the liferaft to the other and which is secured in place by quick release velcro fastening strips.

The end section 24 of the protective tube 19 is seated between and permanently secured to the outer walls of the two buoyancy tubes 13 and 14. At constraint locations 26,27 the protective tube 19 is locally compressed by pairs of lacing patches 28,28' and 29,29' each of which provides localised compression of the tube 19. Constraint locations corresponding to locations 26,27 are provided at the other end of the liferaft where the tube 19 is similarly locally compressed by pairs of lacing patches corresponding to the patches 28,28' and 29,29'. Such compression at the constraint locations as best seen in FIG. 5 provides for preferential bending of the tube 19 at these locations and facilitates movement of the arched tube sections 20,21 from the protective location shown by section 20 in FIG. 1 to the canopy support location shown by section 21 in FIG. 1.

To the end portion 24 of the protective tube 19 is connected a ramp 34 formed by an inflatable bridging tube section 30 permanently secured to the end portion 24 and two inflatable outwardly extending tube sections 32,33 which are in communication with the bridging tube section 30, which is in turn in communication with the end portion 24 of the tube 19 and inflates therewith. The ramp 34 is completed by a ramp floor 35 secured to the ramp tube sections 30,32,33 along the medial lines thereof. An inflatable ramp 34' is provided at the other end of the liferaft 11 and is constructed and arranged in the same manner as the ramp 34.

The protective tube 19 although formed as a continuous tube is sub-divided internally by partitions 8,9 arranged along the centre line of the liferaft and provision is made for inflating one half of the tube 19 by the inflation medium supplied to inflate one of the buoyancy tubes 13,14 and for the other half of the tube 19 to be inflated by the inflation medium supplied to inflate the other of the buoyancy tubes 13,14. Furthermore, inflation of the ramp 34 is carried out by inflation medium supplied to one half of the protective tube 19 while inflation of the ramp 34' at the other end of the liferaft is carried out by inflation medium supplied to the other half of the protective tube 19.

It will be seen that when the arched tube sections 20,21 are in their protective locations in which they seat between and against the outer walls of the two buoyancy tubes 13,14 and are covered by an associated cover sheet 10, the inflated liferaft is fully or substantially fully symmetrical with respect to the floor 15 and can be deployed on water either way up and boarded and used by survivors either way up.

In use, in an emergency, where for example a helicopter is forced to make a landing on water, the liferaft 11 in collapsed and packed condition is ejected either manually or automatically from the helicopter and inflates automatically upon its deployment in water. At this stage, the two buoyancy tubes 13,14 have inflated through non-return valves from a high pressure gas inflation unit and the two halves of the protective tube 19 and the ramp tube sections 30,32,33 of the ramps 34,34' have also inflated from the one or other of the two buoyancy tubes from which inflation medium is supplied also through non-return valves. The liferaft, at this time, takes up a floating disposition on the water and as it is symmetrical with respect to the plane of the floor 15 can be boarded in this condition either way up.

To facilitate boarding of the liferaft by evacuees of the helicopter, the liferaft is tethered by a releasable bowsing strop 37 to the helicopter door threshold and by a long painter line 38. In rough seas and strong winds, the deployed liferaft 11 is likely to impact with the helicopter fuselage and possibly with the rotor blades and in such conditions the exposure of the buoyancy tubes 13,14 to such impacts needs to be minimised.

To this end, each of the inflated arched tube sections 20,21 together with its associated cover sheet 10 serves as a fender for the buoyancy tubes 13,14 and provides protection for them at the time that the arched tube sections 20,21 are vulnerable to impact and when they are not required for supporting the canopy. Advantageously, the protective arched tube sections 20,21 and the canopy sheets 22,22' and 23,23', which in themselves provide added protection, as well as the associated cover sheets 10, are made of an abrasion resistant material such as polyurethane. In addition, the liferaft 11 is so tethered by the bowsing strop 37 and the painter line 38 as to ensure that the protective arched tube sections 20,21 interface with the helicopter, with the boarding ramps 34,34' normal to these restraints and well clear of the helicopter.

Personnel being transported by helicopter to offshore installations are now normally required to wear survival suits during flights over rough seas and are well protected for the short time they take in boarding the deployed liferaft and erecting the canopy. If circumstances permit, they may jump straight into the liferaft from the helicopter or they may jump into the water and climb into it using the ramps 34,34'. Once all the evacuees have boarded, the liferaft is released from close proximity to the helicopter by releasing the bowsing strop 37. The liferaft 11 is then moved clear from the helicopter and erection of the canopy is then carried out. Once clear of the helicopter, the protection afforded by the arched tube sections 20,21 and the associated canopy top and side sheets as well as the associated cover sheets 10 is no longer required. The liferaft nevertheless remains tethered to the helicopter by the long painter line 38 to aid location by rescue services and is completely released by cutting the painter line 38 only when circumstances demand it.

Erection of the canopy is carried out by raising the two arched tube sections 20,21 to the position of tube section 21 shown in FIG. 1. This manoeuvre which brings the two arched tube sections 20,21 to their canopy support locations can advantageously be carried out with the liferaft either way up on the water.

It will be appreciated that in raising the two arched tube sections 20,21 to their canopy support locations the tube 19 is required to flex at the roots of the two sections. This is achieved in the present embodiment of the invention by local compression of the tube 19 at the constraint locations 26,27 at one end of the liferaft and at corresponding constraint locations at the other end of the liferaft. As best seen in FIG. 5 the compression at each constraint location is obtained by drawing together on each side of the tube section pairs of fabric loops 41,42 using tie cords 43. As a result of such compression the protective tube 19 preferentially flexes at the constraint locations and allows for the raising of the two arched tube sections 20,21 without undue distortion or bending of them.

Referring now to FIG. 6, erection of the canopy is facilitated by the use of lanyards 44,45 which extend from the top sheets 23,23' and which are withdrawn by an occupant 46 of the liferaft and connected together following removal of the cover sheets 10 and displacement of the arched tube sections 20,21 from their seated positions. One of the lanyards 44,45 is provided with a free end which passes through a slider and the arched tube sections 20,21 are raised to their canopy support locations by the occupant 46 pulling on the free end and drawing the two top sheets 23,23' together. As will be seen from FIG. 1, the canopy top sheet 23 extends only marginally across the top of the liferaft and the canopy roof is completed by the drawing over to it a much longer canopy top sheet 23'. When the two top sheets 23,23' are fully stretched they are then closed using velcro fastening strips provided along the edges of the top sheets. Openings (not shown) are provided in the larger top sheet 23' to provide for entry of survivors into the liferaft from the ramps 34,34'. The fully inflated liferaft with the canopy fully deployed is shown in FIG. 4.

While the operation of manually erecting the canopy support structure and the canopy of the liferaft described with reference to FIGS. 1 to 6 of the drawings would present little difficulty to trained service personnel and personnel used to hazards at sea, it could be found difficult for persons unused to such hazards and in particular in a crowded liferaft in windy or heavy sea conditions and particularly so when the operation needs to be carried out in darkness. The need therefore may arise for automatic deployment of the arched tube sections 20,21 of the canopy support structure into their support locations and in the second embodiment of the invention now to be described with reference to FIGS. 7 to 11 provision is made for such automatic deployment.

Referring now to FIGS. 7 to 9 of the drawings, an inflatable liferaft 111 comprises a peripheral buoyancy tube side wall structure 12 formed by upper and lower superposed inflatable buoyancy tubes 13 and 14 and a floor 15. At the centre of the floor 15, as best seen in FIG. 9, are secured on opposite surfaces of the floor inflatable endless tubes 16 and 17 defining a central region of the floor which is double skinned to provide a space 18 for housing survival and emergency aid packs, access to which can be obtained from either side of the floor by means of waterproof zips in the two skins of the floor.

The liferaft 111 further comprises an inflatable protective tube structure formed by two displaceable arched tube sections 20 and 21 both of which are inflated when the buoyancy tubes 13 and 14 are inflated upon deployment of the liferaft into the water and both of which are displaceable from protective locations in which they extend round the side wall structure 12 and seat between and against the buoyancy tubes 13 and 14 and canopy support locations in which they provide arched tube supports for a canopy assembly. In FIG. 7, the tube section 20 is shown in the protective location while the tube section 21 is shown in its canopy support location in which it provides an arched tube support for a canopy assembly comprising a canopy side sheet 22 connected to and extending from the junction of the buoyancy tubes 13 and 14 to the tube section 21 and a canopy top sheet 23 connected to the tube section 21.

In the protective location, as illustrated by the tube section 20 in FIG. 10, a canopy side sheet 22', corresponding to the side sheet 22 is held in a collapsed and folded condition between the tube section 20 and the two buoyancy tubes 13 and 14 and a canopy top sheet 23' corresponding to the top sheet 23 is held, for example by quick release ties (not shown), in a collapsed and folded condition against the outside of the tube section 20.

As best seen in FIGS. 7 and 8, the tube sections 20 and 21 are terminated at one end of the liferaft by end portions 124 and 124' which are secured to the outer walls of the two buoyancy tubes 13 and 14. The tube sections 20 and 21 are similarly terminated at the other end of the liferaft by end portions 125,125' also secured to the two buoyancy tubes 13 and 14. At constraint locations 26 and 27, as well as at corresponding constraint locations at the other end of the liferaft, the tube sections 20 and 21 are held compressed by pairs of quick release lacing patches 128,128' and 129,129', each of which, as best seen in FIG. 11, is releasable by a pull cord which effects release of the two halves of the patch when a pull is exerted on an appropriate one of two pull cord handles 130 and 130'.

To the end portions 124 and 124' of the tube sections 20 and 21 are connected ramp tubes 132 and 133 of a ramp 134. The tubes 132 and 133 are in communication with the tube sections 20 and 21 and inflate therewith. As will be seen, the ramp tubes 132 and 133 extend outwardly from the liferaft in the plane of the floor and the ramp 134 includes a fabric floor 135 slung between them. A further ramp 134' of the same construction is provided at the other end of the liferaft 111. As illustrated in FIG. 8, a plurality of water pockets 136 are secured in spaced relation to the underside of the buoyancy chamber 14 and likewise a plurality of similar water pockets (not shown) are provided on the upper buoyancy tube 13. Similarly, lifelines 139 are provided on both the upper and lower buoyancy tubes 13 and 14.

In use, in an emergency, the liferaft 11 in packed condition is discharged into the water. At this time, the two buoyancy tubes 13 and 14 inflate through non-return valves from a high pressure gas inflation unit. At the same time, inflation of the protective tube sections 20 and 21 and the associated ramp tubes 132 and 133 takes place, with one of the tube sections 20,21 and its associated ramp tube 132,133 being inflated by gas from one of the buoyancy tubes through a non-return valve and the other of the tube sections 20 and 21 and its associated ramp tube 132,133 being inflated likewise by gas from the other buoyancy tube through a non-return valve. Once all the evacuees have boarded, for example from a ditched helicopter, the liferaft 111 is moved clear from any obstructions and erection of the canopy carried out simply by pulling on the four release handles 130 or 130' found at the four constraint locations, the release handles 130' being employed for releasing the lacing patches 129' for erection of the arched tube sections 20 and 21 as shown in FIG. 7 and the pull handles 130 where the liferaft is deployed the other way up on the water. Upon release of the patches 129', as shown in FIG. 11, the tube sections 20 and 21 become subjected to deformation as shown and are displaced out of their seats between the buoyancy tubes 13 and 14 and take up canopy support locations above the liferaft floor as illustrated by the tube section 21 in FIGS. 7 and 8. The canopy side sheets 22,22' unfold and spread out to provide a canopy side wall and the top canopy sheets 23,23' move to positions in which they can be secured together by velcro fastening or other attachment means to provide a fully closed canopy, apart from a doorway 147 which can be used for boarding of further evacuees and for lookout purposes.

We claim:

1. An inflatable liferaft comprising an inflatable buyoancy tube side wall structure and a floor so secured at its periphery to the side wall structure that the inflated liferaft can be used when deployed on water either way up, an inflatable protective tube structure, supply means to supply inflation medium to the side wall structure and the protective tube structure upon deployment of the liferaft to inflate the protective tube structure and the side wall structure together, said protective tube structure being so constructed and arranged in relation to the side wall structure that when inflated with the side wall structure it takes up a protective location in which it extends entirely round the outside of the side wall structure to protect the side wall structure from damage and from which it is displaceable either way to a canopy support location above the floor of the liferaft, and a canopy assembly so secured to the protective tube structure and to the side wall structure that when the protective tube structure moves to its canopy support location the canopy assembly deploys with the protective tube structure and is supported thereby.

2. A liferaft according to claim 1, wherein the canopy assembly comprises a canopy side sheet connected to and extending between the side wall structure and the protective tube structure and a canopy top sheet connected to the protective tube structure and arranged in the canopy support location of the protective tube structure to extend across the top of the liferaft.

3. A liferaft according to claim 2, wherein when the protective tube structure is in the protective location the canopy side sheet is held in a collapsed and folded condition between the protective tube structure and the side wall structure and the canopy top sheet is held in a collapsed and folded condition against the outside of the protective tube structure.

4. A liferaft according to claim 3, wherein the protective tube comprises one or more displaceable arched tube sections, the or each of which extends round the sidewall structure between constraint locations thereon and is displaceable into a canopy support location to provide an arched tube support for the canopy assembly.

5. A liferaft according to claim 4, wherein the protective tube comprises two displaceable arched tube sections, one of which extends in the protective location round one half of the side wall structure of the liferaft and is displaceable to a first canopy support location and the other of which extends round the other half of the side wall structure and is displaceable to a second canopy support location spaced from the first support location.

6. A liferaft according to claim 5, wherein the side wall structure comprises two superposed inflatable buoyancy tubes and wherein the two arched tube sections are arranged in the protective location to seat between and against the outer walls of the two buoyancy tubes.

7. A liferaft according to claim 6, wherein one of the arched tube sections is inflated by the inflation medium supplied to inflate one of the buoyuancy tubes of the side wall structure and wherein the other arched tube section is inflated by the inflation medium supplied to inflate the other buoyancy tube of the side wall structure.

8. A liferaft according to claim 5, wherein the canopy top sheet comprising two top sheet portions, one of which is secured to one of the arched tube sections and the other of which is secured to the other arched tube section and wherein the arrangement is such that when the two arched tube section take up their canopy support locations the extended two top sheet portions abut or overlap and can be secured together to form a continuous canopy roof.

9. An inflatable liferaft comprising an inflatable buoyancy tube side wall structure that the inflated liferaft can be used when deployed on water either way up, an inflatable protective tube structure which upon deployment of the liferaft inflates with the side wall structure to take up a protective location in which it extends round the outside of the side wall structure and which is displaceable from its protective location either way to a canopy support location above the floor of the liferaft, a canopy assembly so secured to the protective tube structure and to the side wall structure that when the protective tube structure moves to its canopy support location the canopy assembly deploys with the protective tube structure and is supported thereby, said canopy assembly comprises a canopy side sheet connected to and extending between the side wall structure and the protective tube structure and a canopy top sheet connected tothe protective tube structure and arranged in the canopy support location of the protective tube structure to extend across the top of the liferaft, when the protective tube structure is in the protective location the canopy side sheet is held in a collapsed and folded condition between the protective tube structure and the side wall structure and the canopy top sheet is held in a collapsed and folded condition against the outside of the protective tube structure, said protective tube structure comprises an inflatable protective tube extending round the sidewall structure in the protective location which has one or more displaceable arched tube sections, the or each of which extends round the sidewall structure between constraint locations thereon and is displaceable into a canopy support location to provide an arched tube support for the canopy assembly, and said protective tube is held axially compressed at constraint locations by constraint elements, whereby when the or each arched tube section is displaced in the direction of its canopy support location it bends locally at the constraint locations.

10. An inflatable liferaft comprising an inflatable buoyancy tube side wall structure and a floor so secured at its periphery to the side wall structure that the inflated liferaft can be used when deployed on water either way up, an inflatable protective tube structure which upon deployment of the liferaft inflates with the side wall structure to take up protective location in which it extends round the outside of the side wall structure and which is displaceable from its protective location either way to a canopy support location above the floor of the liferaft, a canopy assembly so secured to the protective tube structure and to the side wall structure that when the protective tube structure moves to its canopy support location the canopy assembly deploys with the protective tube structure and is supported thereby, said canopy assembly comprises a canopy side sheet connected to and extending between the side wall structure and the protective tube structure and a canopy top sheet connected to the protective tube structure and arranged in the canopy support location of the protective tube structure to extend across the top of the liferaft, when the protective tube structure is in the protective location the canopy side sheet is held in a collapsed and folded condition between the protective tube structure and the side wall structure and the canopy top sheet is held in a collapsed and folded condition against the outside of the protective tube structure, said protective tube structure comprises an inflatable protective tube extending round the sidewall structure in the protective location which has one or more displaceable arched tube sections, the or each of which extends round the sidewall structure between constraint locations thereon and is displaceable into a canopy support location to provide an arched tube support for the canopy assembly, and said protective tube is held axially compressed at constraint locations by constraint elements which bias the or each arched tube section to cause it to move automatically to one or other of its canopy support locations upon selective removal or overriding of one or more of the constraint elements.

11. A liferaft according to claim 10, wherein the side wall structure comprises two superposed inflatable buoyancy tubes, wherein the or each arched tube section is arranged in the protective location to seat between and against the outer walls of the two buoyancy tubes and wherein compression of the inflatable protective tube at the constraint locations is such as upon selective removal of the constraint elements the or each arched tube section is displaced out of its seat between the buoyancy tubes and moves to its support location.

* * * * *